US007158100B2

(12) United States Patent
Ide

(10) Patent No.: US 7,158,100 B2
(45) Date of Patent: Jan. 2, 2007

(54) DRIVING APPARATUS FOR DISPLAY PANEL

(75) Inventor: Shigeo Ide, Yamanashi-ken (JP)

(73) Assignees: Pioneer Corporation, Tokyo (JP); Pioneer Display Products Corporation, Shizuoka-ken (JP)

( * ) Notice: Subject to any disclaimer, the term of this patent is extended or adjusted under 35 U.S.C. 154(b) by 432 days.

(21) Appl. No.: 10/653,425

(22) Filed: Sep. 3, 2003

(65) Prior Publication Data

US 2004/0130507 A1 Jul. 8, 2004

(30) Foreign Application Priority Data

Sep. 4, 2002 (JP) ..... 2002-258833

(51) Int. Cl.
*G09G 3/28* (2006.01)

(52) U.S. Cl. ..... 345/60; 345/60; 345/87

(58) Field of Classification Search ..... 345/60, 345/519, 204, 30, 36, 38, 55, 80, 100, 206, 345/87

See application file for complete search history.

(56) References Cited

U.S. PATENT DOCUMENTS 6,331,844 B1 * 12/2001 Okumura et al. ..... 345/87
2002/0021265 A1 * 2/2002 Ishii et al. ..... 345/60

* cited by examiner

*Primary Examiner*—Richard Hjerpe
*Assistant Examiner*—Tammy Pham
(74) *Attorney, Agent, or Firm*—Sughrue Mion, PLLC

(57) ABSTRACT

Application timing of driving pulses for a PDP is controlled so that a flow direction of a discharge current which flows between a first row electrode and a second row electrode of each of row electrode pairs belonging to odd numbered display lines due to the electrical discharge is opposite to a flow direction of a discharge current which flows between a first row electrode and a second row electrode of each of row electrode pairs belonging to even numbered display lines. Furthermore, an impedance of a current channel for the discharge current which flows between the row electrode pair belonging to the odd numbered display line and the electrode driving means is made substantially the same as an impedance of a current channel for the discharge current which flows between the row electrode pair belonging to the even numbered display line and the electrode driving means.

16 Claims, 5 Drawing Sheets

DRIVING APPARATUS FOR DISPLAY PANEL

BACKGROUND OF THE INVENTION

1) Field of the Invention

The present invention relates to a driving apparatus for driving a display panel.

2) Description of the Related Art

Recently, a display panel comprising capacitive light emitting elements such as a plasma display panel (hereinafter referred to as PDP) or an electroluminescence display panel is receiving attention as a wall-mounted TV.

FIG. 1 of the accompanying drawings is a diagram showing a schematic structure of the PDP.

In FIG. 1, a PDP 10 has a front substrate (not shown) serving as a display screen and a back substrate (not shown) provided to face the front substrate so as to sandwich a discharge space including a discharge gas between the front and back substrates. On the front substrate, strip-shaped row electrodes $X_1$–$X_n$ and $Y_1$–$Y_n$ are alternately formed so as to be aligned parallel with each other. On the back substrate, strip-shaped column electrodes $D_1$–$D_m$ are formed so as to perpendicularly cross each of the row electrodes. The row electrodes $X_1$–$X_n$ and $Y_1$–$Y_n$ are configured such that each pair of row electrodes X and Y serves as a display line. The row electrodes $X_1$–$X_n$ and $Y_1$–$Y_n$ define the first display line to the n-th display line. Accordingly, a discharge cell serving as a pixel is formed at a crossing portion (including the discharge space) of each pair of row electrodes and each column electrode. Each discharge cell has one of two states, i.e., a light emission state and a non-light emission state, depending on whether an electrical discharge occurs in the discharge cell or not. Specifically, the discharge cell expresses only two luminance gradations, i.e., the lowest luminance (non-light emitting state) and the highest luminance (light emitting state).

Gradation drive using a subfield method is performed in order to achieve a display with halftone luminance which corresponds to an input video signal to the PDP 10 having such discharge cells.

According to the subfield method, each pixel of the input video signal is converted into pixel data of N bits, and a display period of one field (frame) is divided into N subfields (subframes) corresponding to N digits of the N-bit pixel data. The number of discharges corresponding to a weight of the subfield is allocated to the subfield. The discharge is caused only in the subfield which is selected based on the video signal. The halftone luminance corresponding to the video signal is achieved by the overall discharges in one field display period which corresponds to the summation of the number of discharges caused in all the subfields of the frame.

A driving control circuit 50 supplies timing signals to each of an address driver 20, a Y-electrode driver 30 and an X-electrode driver 40, so as to gradation drive the PDP 10 in accordance with the above-mentioned subfield method. Furthermore, the driving control circuit 50 converts each pixel of the input video signal into pixel data of N bits. After dividing the pixel data into N bit digits, the driving control circuit 50 allocates each pixel data bit to the respective subfield which corresponds to the bit digit concerned. Thereafter, the driving control circuit 50 supplies the pixel data bits to the address driver 20 such that the pixel data bits (m bits) per each display line are sequentially supplied at a time in each subfield.

FIG. 2 is a diagram showing various driving pulses and their application timing which are applied to the PDP 10 in each subfield by each of the address driver 20, the Y-electrode driver 30 and the X-electrode driver 40 in accordance with the above-mentioned control operation.

First, in an all-resetting step Rc, the X-electrode driver 40 generates reset pulses $RP_X$ of negative polarity and applies the pulses to each of the row electrodes $X_1$–$X_n$. Furthermore, in the all-resetting step Rc, the Y-electrode driver 30 generates reset pulses $RP_Y$ of positive polarity and simultaneously applies the pulses to each of the row electrodes $Y_1$–$Y_n$. All discharge cells in the PDP 10 are reset-discharged in response to the application of the reset pulses $RP_X$ and $RP_Y$ and wall charges of a predetermined amount are uniformly formed in each discharge cell. All of the discharge cells are, thus, initialized to a light emitting cell state.

In a pixel data writing step Wc, the address driver 20 sequentially converts the pixel data bits (m bits), which are sequentially supplied per each display line at a time, into m pixel data pulses. For example, the address driver 20 generates the pixel data pulse of a high voltage when the pixel data bit is a logic level 1, whereas the address driver 20 generates the pixel data pulse of a low voltage (0 volt) when the pixel data bit is a logic level 0. Then, the address driver 20 sequentially applies the pixel data pulse groups DP1, DP2, DP3, . . . , and DP(n), which are formed by grouping the pixel data pulses per each display line (m pulses), to the column electrodes $D_1$–$D_m$ as shown in FIG. 2. Furthermore, in each application timing, the Y-electrode driver 30 sequentially applies scan pulses SP of negative polarity as shown in FIG. 2 to the row electrodes $Y_1$–$Y_n$, in synchronization with the application timing of each of the pixel data pulse groups DP. In this instance, a discharge (selective erasure discharge) occurs only in the discharge cells in crossing portions of the row electrodes to which the scan pulses SP have been applied and the column electrodes to which the high voltage pixel data pulses DP have been applied, and the wall charges remaining in those discharge cells are erased. Accordingly, the discharge cells initialized to the light emitting cell state in the all-resetting step Rc are shifted to the non-light emitting cell state. On the other hand, the selective erasure discharge does not occur in the discharge cells where the pixel data pulses DP of the low voltage have been applied, even though the scan pulses SP have been applied thereto. Thus the initialized state in the all-resetting step Rc, namely, the light emitting cell state is maintained.

In a light emission sustaining step Ic, the X-electrode driver 40 repetitively applies sustain pulses $IP_X$ of positive polarity to the row electrodes $X_1$–$X_n$ as shown in FIG. 2. Furthermore, in the light emission sustaining step Ic, the Y-electrode driver 30 repetitively applies sustain pulses $IP_Y$ of positive polarity to the row electrodes $Y_1$–$Y_n$ with a difference in the application timing from the sustain pulses $IP_X$. In this instance, only the discharge cells in which the wall charges remain, i.e., only the discharge cells in the light emitting cell state, discharge (sustain-discharge) every time the sustain pulses $IP_X$ and $IP_Y$ are alternately applied. Specifically, only the discharge cells set to the light emitting cell state during the pixel data writing step Wc repeat the light emission due to the sustain-discharge, with the number of applications corresponding to the weight of this subfield, and sustain the light emitting state. The number of applications of the sustain pulses $IP_X$ and $IP_Y$ has been previously setup in accordance with the weight of the subfield concerned.

In an erasing step E, the Y-electrode driver 30 applies erasing pulses EP to the row electrodes $Y_1$–$Y_n$ as shown in FIG. 2. All of the discharge cells are, thus, allowed to erasure-discharge at once, thereby extinguishing the wall charges remaining in the discharge cells.

By executing the above-mentioned series of operations a plurality of times in each field, the halftone luminance can be visually recognized which corresponds to the total number of the sustain discharges generated in the light emission sustaining step Ic in the subfields of that field.

According to the driving operation, a discharge current due to the sustain discharge flows to the Y-electrode driver 30 via a current channel including the X-electrode driver 40, the row electrodes $X_1$–$X_n$ and the row electrodes $Y_1$–$Y_n$ during a rising period of the sustain pulses $IP_X$. On the other hand, a discharge current flows to the X-electrode driver 40 via a current channel including the Y-electrode driver 30, the row electrodes $Y_1$–$Y_n$ and the row electrodes $X_1$–$X_n$ during a rising period of the sustain pulses $IP_Y$. Specifically, the current flow behavior of the discharge current from the row electrodes $X_1$–$X_n$ to the row electrodes $Y_1$–$Y_n$ and the other current flow behavior of the discharge current from the row electrodes $Y_1$–$Y_n$ to the row electrodes $X_1$–$X_n$ are alternately repeated in the light emission sustaining step Ic. In this instance, when the sustain discharge is generated in one of the discharge cells on the display line, the discharge current flows between a pair of the row electrodes X and Y serving as such display line. Specifically, when the sustain pulses $IP_X$ (or $IP_Y$) are simultaneously applied to the row electrodes $X_1$–$X_n$ (or $Y_1$–$Y_n$) as shown in FIG. 2, the discharge currents are likely to flow from each of the row electrodes X (or Y) to each of the row electrodes Y (or X) at once. Accordingly, when the currents flow through a large number of the display lines in the same direction, an unnecessary electromagnetic radiation is likely to increase due to the generation of a strong magnetic field within the panel surface.

SUMMARY OF THE INVENTION

An object of the present invention is to provide a driving apparatus for a display panel that has a capability to alleviate the unnecessary electromagnetic radiation.

According to one aspect of the present invention, there is provided a driving apparatus for driving a display panel which has a plurality of strip-shaped row electrode pairs aligned parallel with each other so as to serve as display lines on an internal surface of one of two substrates facing each other with a discharge space between the substrates, and each row electrode pair includes a first electrode and a second electrode. The driving apparatus comprises electrode driving means for generating an electrical discharge within the discharge space by alternately applying driving pulses to the first row electrode and the second row electrode forming each row electrode pair, and driving control means for controlling application timing of the driving pulses so that a flow direction of a discharge current which flows between the first row electrode and the second row electrode of each of the row electrode pairs belonging to odd numbered display lines due to the electrical discharge is opposite to a flow direction of the discharge current which flows between the first row electrode and the second row electrode of each of the row electrode pairs belonging to even numbered display lines, wherein an impedance of a current channel for the discharge current which flows between the row electrode pair belonging to the odd numbered display line and the electrode driving means is substantially the same as an impedance of a current channel for the discharge current which flows between the row electrode pair belonging to the even numbered display line and the electrode driving means.

According to another aspect of the present invention, there is provided a driving apparatus for driving a display panel which has a plurality of strip-shaped row electrode pairs aligned parallel with each other so as to serve as display lines on an internal surface of one of two substrates facing each other with a discharge space between the substrates, and each row electrode pair includes a first electrode and a second electrode. The driving apparatus comprises electrode driving means for generating an electrical discharge within the discharge space by alternately applying driving pulses to the first row electrode and the second row electrode forming each row electrode pair, and driving control means for controlling application timing of the driving pulses so that a flow direction of a discharge current which flows between the first row electrode and the second row electrode of each of the row electrode pairs belonging to odd numbered display lines due to the electrical discharge is opposite to a flow direction of the discharge current which flows between the first row electrode and the second row electrode of each of the row electrode pairs belonging to even numbered display lines, wherein a length of a current channel for the discharge current flowing between the row electrode pair belonging to the odd numbered display line and the electrode driving means is substantially the same as a length of a current channel for the discharge current flowing between the row electrode pair belonging to the even numbered display line and the electrode driving means.

DETAILED DESCRIPTION OF THE INVENTION

Figure 1:
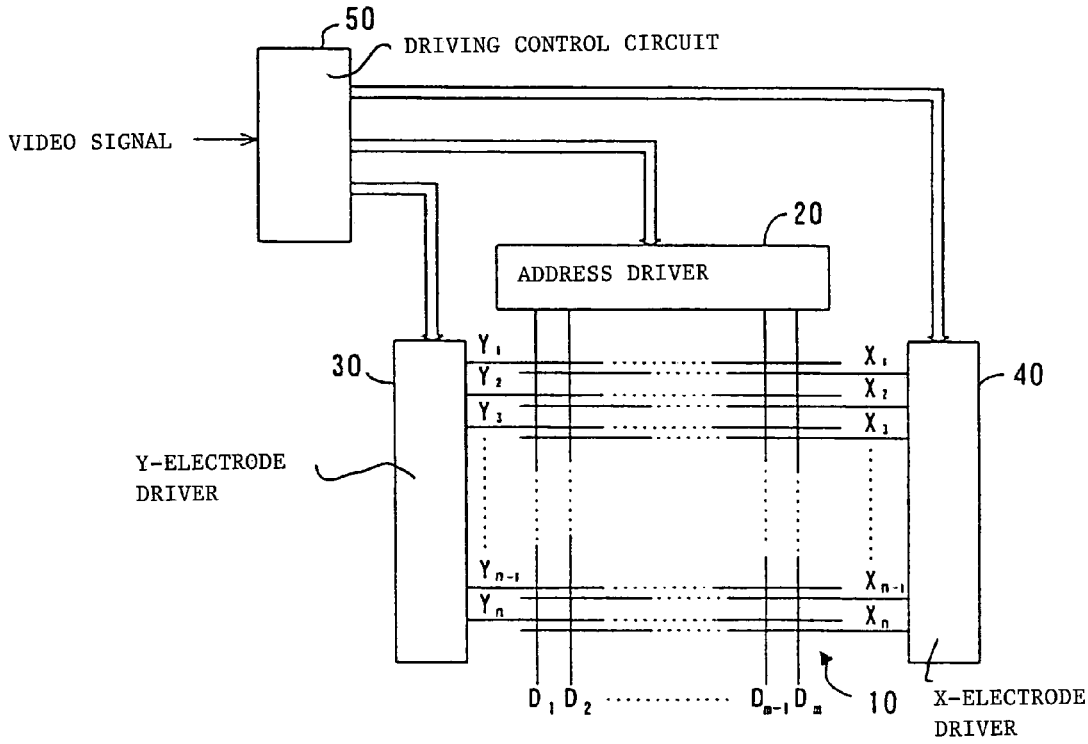
FIG. 1 shows a schematic structure of a conventional PDP.
Figure 2:
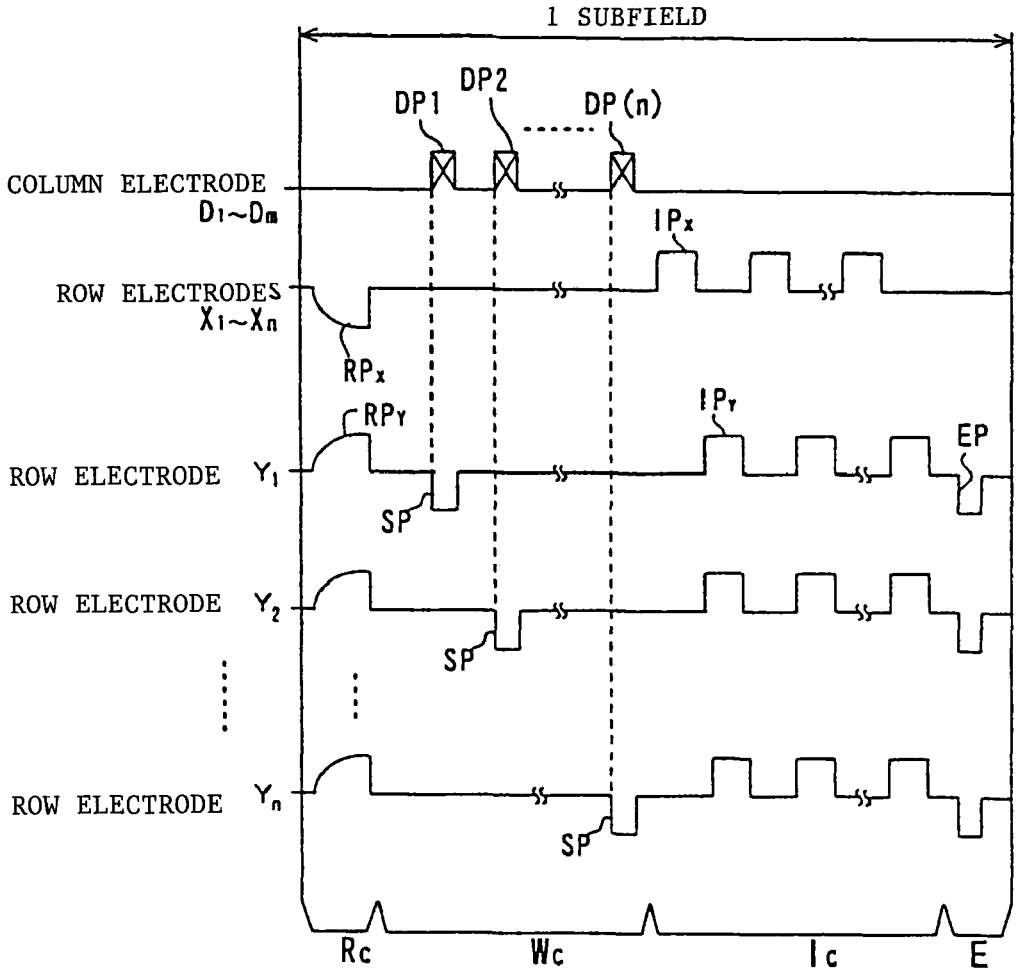
FIG. 2 shows various driving pulses and their application timing which are applied to the PDP shown in FIG. 1.
Figure 3:
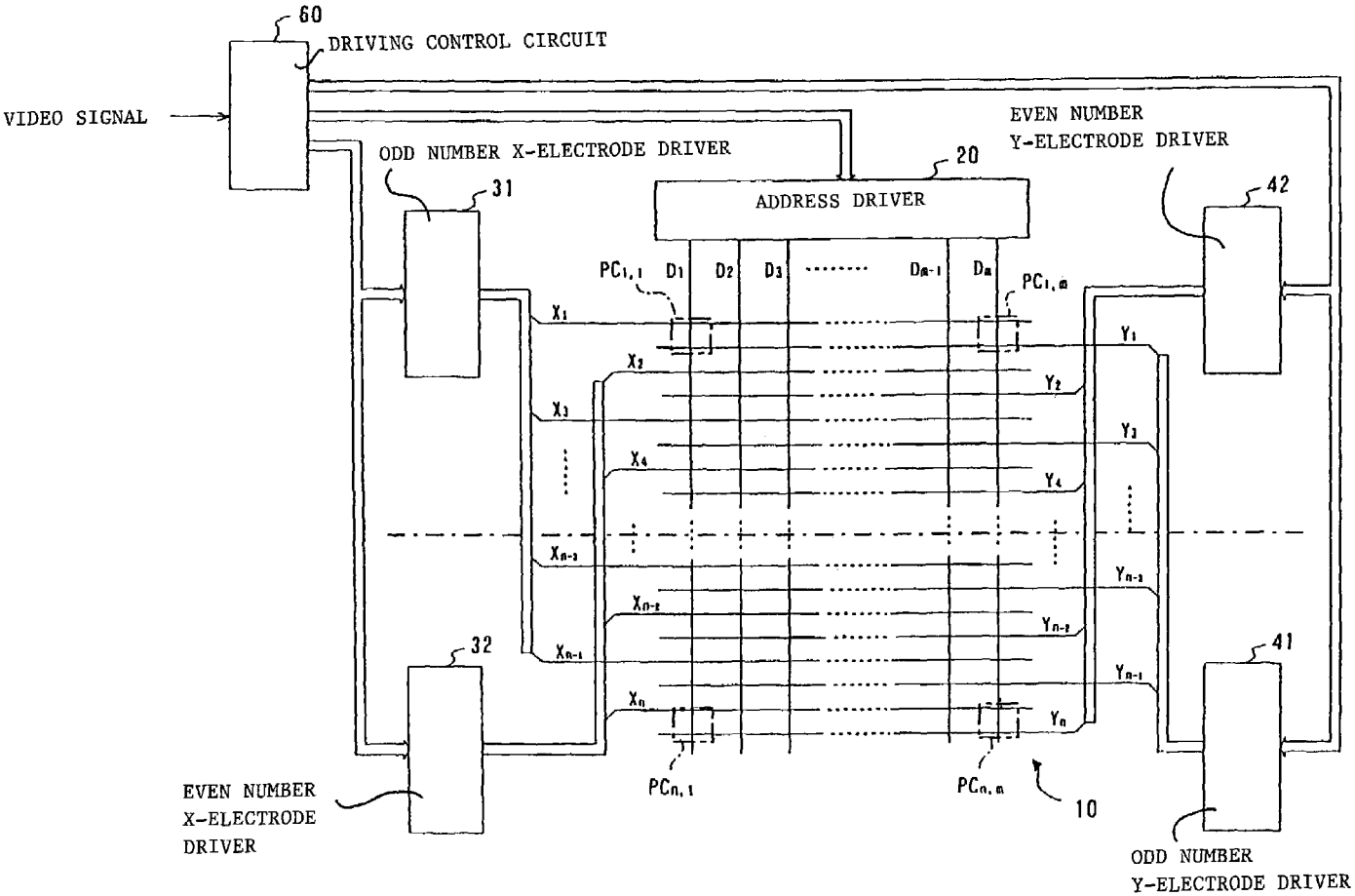
FIG. 3 shows a schematic structure of a PDP equipped with a driving apparatus according to an embodiment of the present invention.

FIG. 3 is an illustration showing a structure of a PDP including a driving apparatus according to an embodiment of the invention.

In FIG. 3, the PDP 10 has a front substrate (not shown) serving as a display screen and a back substrate (not shown) formed to face the front substrate so as to sandwich a discharge space including a discharge gas between the front and the back substrates. On the front substrate, strip-shaped row electrodes $X_1$–$X_n$ and $Y_1$–$Y_n$ are alternately formed so as to be aligned parallel with each other. The row electrodes $X_1$–$X_n$ and $Y_1$–$Y_n$ are configured such that the row electrodes X and Y are alternately arranged, for example, $X_1$, $Y_1$, $X_2$, $Y_2$, $X_3$, $Y_3$, . . . , $X_n$ and $Y_n$, as shown in FIG. 3, so that each pair of row electrodes X and Y adjoining with each other serves as a display line. The row electrodes $X_1$–$X_n$ and $Y_1$–$Y_n$ define the first display line to the n-th display line. On the back substrate, strip-shaped column electrodes $D_1$–$D_m$ are formed so as to perpendicularly cross each of the row electrodes. Accordingly, a discharge cell PC serving as a pixel is formed at a crossing portion (including the discharge space) of each pair of row electrodes and each column electrode.

A driving control circuit 60 supplies various timing signals to each of an odd number X-electrode driver 31, an even number X-electrode driver 32, an odd number Y-electrode driver 41 and an even number Y-electrode driver 42, so as to gradation drive control the PDP 10 in accordance with the subfield (subframe) method. Furthermore, the driving control circuit 60 converts each pixel of the input video signal into pixel data of N bits. After dividing the pixel data into N bit digits, the driving control circuit 60 allocates each pixel data bit to the respective subfield which corresponds to the bit digit concerned. Thereafter, the driving control circuit 60 supplies the pixel data bits to the address driver 20 such that pixel data bits (m bits) per each display line are sequentially supplied at a time in each subfield.

The address driver 20 converts each of the pixel data bits (m bits), which are sequentially supplied per each display line at a time from the driving control circuit 60, into m pixel data pulses having voltages in accordance with individual logic levels, and applies the pulses to the column electrodes $D_1$–$D_m$.

The odd number X-electrode driver 31 applies various driving pulses (described below) to odd numbered row electrodes X in the PDP 10, i.e., the row electrodes $X_1$, $X_3$, $X_5$, . . . , $X_{n-3}$ and $X_{n-1}$, in response to the timing signals supplied from the driving control circuit 60. The even number X-electrode driver 32 applies various driving pulses (described below) to even numbered row electrodes X in the PDP 10, i.e., the row electrodes $X_2$, $X_4$, . . . , $X_{n-2}$ and $X_n$, in response to the timing signals supplied from the driving control circuit 60. The odd number Y-electrode driver 41 applies various driving pulses (described below) to odd numbered row electrodes Y in the PDP 10, i.e., the row electrodes $Y_1$, $Y_3$, $Y_5$, . . . , $Y_{n-3}$ and $Y_{n-1}$, in response to the timing signals supplied from the driving control circuit 60. The even number Y-electrode driver 42 applies various driving pulses (described below) to even numbered row electrodes Y in the PDP 10, i.e., the row electrodes $Y_2$, $Y_4$, . . . , $Y_{n-2}$ and $Y_n$, in response to the timing signals supplied from the driving control circuit 60.

In a practical application, each of IC chips serving as the odd number X-electrode driver 31 and the even number X-electrode driver 32 is positioned on one side of the row electrode pairs (X and Y), whereas each of the IC chips serving as the odd number Y-electrode driver 41 and the even number Y-electrode driver 42 is positioned on the other side of the row electrode pairs (X and Y) as shown in FIG. 3. Furthermore, as shown in FIG. 3, the IC chip serving as the odd number X-electrode driver 31 is positioned at an upper side of the screen of the PDP 10 with respect to the horizontal center line of the screen (shown as a dashed line), whereas the IC chip serving as the even number X-electrode driver 32 is positioned at a lower side of the screen with respect to the center line. In a similar manner, as shown in FIG. 3, the IC chip serving as the odd number Y-electrode driver 41 is positioned at a lower side of the screen with respect to the center line, whereas the IC chip serving as the even number Y-electrode driver 42 is positioned at an upper side of the screen with respect to the center line.

Figure 4:
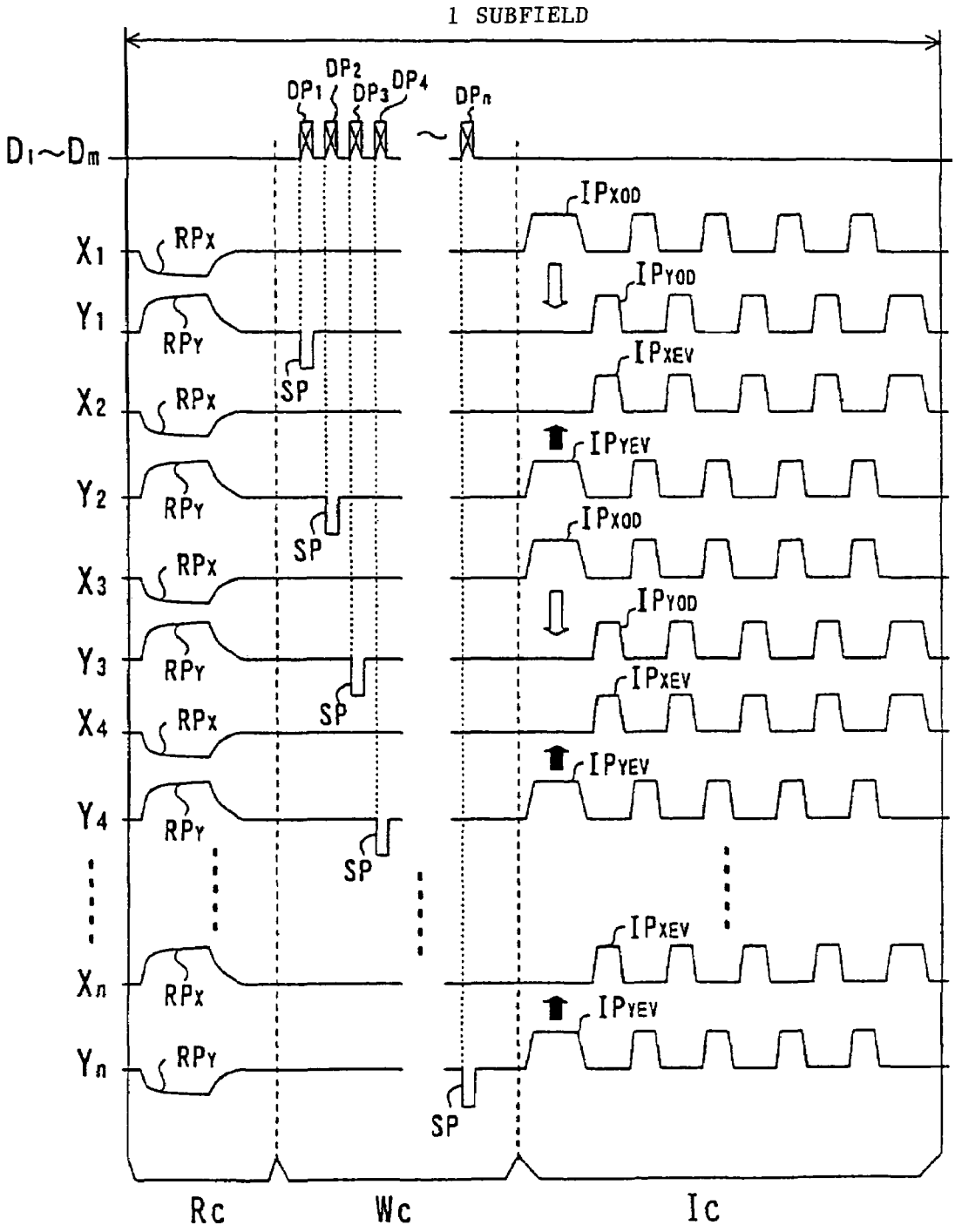
FIG. 4 shows various driving pulses and their application timing which are applied to the PDP shown in FIG. 3.

FIG. 4 is a diagram showing various driving pulses and their application timing which are applied to the PDP 10 in each subfield by the address driver 20, the odd number X-electrode driver 31, the even number X-electrode driver 32, the odd number Y-electrode driver 41 and the even number Y-electrode driver 42, in accordance with the above-mentioned subfield (subframe) method.

First, in an all-resetting step Rc, the odd number X-electrode driver 31 and the even number X-electrode driver 32 generate reset pulses $RP_X$ of negative polarity having waves as shown in FIG. 4, and simultaneously apply the pulses to each of the row electrodes $X_1$–$X_n$ of the PDP 10. Furthermore, in the all-resetting step Rc, the odd number Y-electrode driver 41 and the even number Y-electrode driver 42 generate reset pulses $RP_Y$ of positive polarity having waves as shown in FIG. 4, and simultaneously apply the pulses to each of the row electrodes $Y_1$–$Y_n$ of the PDP 10. All discharge cells in the PDP 10 are reset-discharged in response to the application of the reset pulses $RP_X$ and $RP_Y$ and wall charges of a predetermined amount are uniformly formed in the respective discharge cells. All of the discharge cells are, thus, initialized to a light emitting cell state.

In a pixel data writing step Wc, the address driver 20 sequentially converts the pixel data bits (m bits), which are supplied per each display line at a time, into m pixel data pulses. For example, the address driver 20 generates the pixel data pulse of a high voltage when the pixel data bit is a logic level 1, whereas the address driver 20 generates the pixel data pulse of a low voltage (0 volt) when the pixel data bit is a logic level 0. Then, the address driver 20 sequentially applies the pixel data pulse groups DP1, DP2, DP3, . . . , and DP(n), which are formed by grouping the pixel data pulses per each display line (m pulses), to the column electrodes $D_1$-$D_m$ as shown in FIG. 4. Furthermore, during the above-mentioned application, the odd number Y-electrode driver 41 sequentially applies scan pulses SP of negative polarity as shown in FIG. 4 to the odd numbered row electrodes $Y_1$, $Y_3$, . . . , $Y_{n-1}$, in synchronization with the application timing of each of the odd numbered pixel data pulse groups DP1, DP3, . . . , DP(n−1). In a similar manner, the even number Y-electrode driver 42 sequentially applies scan pulses SP of negative polarity as shown in FIG. 4 to the even numbered row electrodes $Y_2$, $Y_4$, . . . , $Y_n$, in synchronization with the application timing of each of the even numbered pixel data pulse groups DP2, DP4, . . . , DP(n). In this instance, a discharge (selective erasure discharge) occurs only in the discharge cells in crossing portions of the row electrodes to which the scan pulses SP have been applied and the column electrodes to which the high voltage pixel data pulses DP have been applied, and the wall charges remaining in those discharge cells are erased. Consequently, the discharge cells initialized to the light emitting cell state in the all-resetting step Rc are shifted to the non-light emitting cell state. On the other hand, the selective erasure discharge does not occur in the discharge cells where the pixel data pulses DP of the low voltage have been applied, even though the scan pulses SP have been applied thereto. Thus the initialized state in the all-resetting step Rc, namely, the light emitting cell state is maintained.

In a light emission sustaining step Ic, the odd number X-electrode driver 31 repetitively applies sustain pulses $IP_{XOD}$ of positive polarity as shown in FIG. 4 to each of the odd numbered row electrodes $X_1$, $X_3$, . . . , $X_{n-1}$, with the number of applications corresponding to the weight of this subfield. Furthermore, in the light emission sustaining step Ic, the even number X-electrode driver 32 repetitively applies a sustain pulse $IP_{XEV}$ of positive polarity as shown in FIG. 4 to each of the even numbered row electrodes $X_2$, $X_4$, . . . , $X_n$, with the number of applications corresponding to the weight of this subfield. The application timing is different from the above-mentioned sustain pulses $IP_{XOD}$. Furthermore, in the light emission sustaining step Ic, the odd number Y-electrode driver 41 repetitively applies sustain pulses $IP_{YOD}$ of positive polarity as shown in FIG. 4 to each of the odd numbered row electrodes $Y_1$, $Y_3$, . . . , $Y_{n-1}$, with the number of applications corresponding to the weight of this subfield. The application timing is synchronous with that of the sustain pulses $IP_{XEV}$. Furthermore, in the light emission sustaining step Ic, the even number Y-electrode driver 42 repetitively applies sustain pulses $IP_{YEV}$ of positive polarity as shown in FIG. 4 to each of the even numbered row electrodes $Y_2$, $Y_4$, . . . , $Y_n$, with the number of applications corresponding to the weight of this subfield. The application timing is synchronous with that of the sustain pulses $IP_{XOD}$. In this instance, only the discharge cells in which the wall charges remain, i.e., only the discharge cells at the light emitting cell state, discharge (sustain-discharge) and emit light every time the sustain pulses $IP_{XOD}$, $IP_{XEV}$, $IP_{YOD}$ or $IP_{YEV}$ are applied. Specifically, only the discharge cells set to the light emitting cell state during the pixel data writing step Wc repeat the light emission due to the sustain-discharge, with the number of applications corresponding to the weight of this subfield, and sustain the light emitting state.

In the light emission sustaining step Ic shown in FIG. 4, the application timing of the sustain pulses to the odd numbered row electrodes X and the even numbered row electrodes Y ($IP_{XOD}$ and $IP_{YEV}$) are synchronous with each other, when alternately applying the sustain pulses to the row electrodes X and Y. Furthermore, the application timing of the sustain pulses to the even numbered row electrodes X and the odd numbered row electrodes Y ($IP_{XEV}$ and $IP_{YOD}$) are synchronous with each other. Because of such driving operation, a sustain discharge is generated, for example, between the odd numbered row electrodes X and Y in response to the application of the sustain pulse $IP_{XOD}$. This sustain discharge causes a flow of a discharge current from the odd numbered row electrode X to the odd numbered row electrode Y as indicated by white arrows shown in FIG. 4. Since application of the sustain pulses $IP_{YEV}$ is synchronous with that of the sustain pulses $IP_{XOD}$ during the flowing of such discharge current, a similar sustain discharge is generated between the even numbered row electrodes X and Y. This sustain discharge causes a flow of a discharge current from the even numbered row electrode Y to the even numbered row electrode X as indicated by black arrows shown in FIG. 4. Consequently, a flow direction (from X to Y) of the discharge current which flows through the odd numbered display line is opposite to a flow direction (from Y to X) of the discharge current which flows through the even numbered display line.

Accordingly, directions of the magnetic fields generated by the discharge currents are opposite with respect to each other in adjacent display lines. This cancels out the generated magnetic fields, thereby alleviating the generation of unnecessary electromagnetic radiation.

When the even numbered row electrode X (or Y) and the odd numbered row electrode X (or Y) are driven by different drivers, an IC chip serving as a driver for the even numbered row electrode X (or Y) is positioned differently from an IC chip serving as a driver for the odd numbered row electrode X (or Y), even though both IC chips are positioned on the same mounting surface. Therefore, a channel connecting between the odd number X-electrode driver 31 and the row electrode $X_1$ and a channel connecting between the even number X-electrode driver 32 and the row electrode $X_2$ have different lengths with respect to each other as shown in FIG. 3. Consequently, such difference in channel length causes a timing shift between the sustain discharges generated in the discharge cells belonging to the even numbered display lines and the sustain discharges generated in the discharge cells belonging to the odd numbered display lines, under the condition that other configurations are the same with each other. Accordingly, the above-mentioned canceling out effect for the magnetic fields is reduced and a streaky unevenness is generated on the display screen.

As a practical solution to the above problem, the IC chips serving as the odd number X-electrode driver 31 and the even number X-electrode driver 32 are positioned on one side (end) of the pairs of row electrodes X and Y, and the IC chips serving as the odd number Y-electrode driver 41 and the even number Y-electrode driver 42 are positioned on the other side (end) of the pairs of row electrodes X and Y as shown in FIG. 3. Furthermore, as shown in FIG. 3, the IC chip serving as the odd number X-electrode driver 31 is positioned at an upper side of the screen of the PDP 10 with respect to the horizontal center line (shown as a dashed line), whereas the IC chip serving as the even number X-electrode driver 32 is positioned at a lower side of the screen with respect to the center line. In a similar manner, as shown in FIG. 3, the IC chip serving as the odd number Y-electrode driver 41 is positioned at a lower side of the screen with respect to the center line, whereas the IC chip serving as the even number Y-electrode driver 42 is positioned at an upper side of the screen with respect to the center line. Consequently, the channel of the discharge current between the odd number X-electrode driver 31 and the odd number Y-electrode driver 41 and the channel of the discharge current between the even number X-electrode driver 32 and the even number Y-electrode driver 42 have substantially the same length, even though the channel between the odd number X-electrode driver 31 and the row electrode X and the channel between the even number X-electrode driver 32 and the row electrode X have different lengths with respect to each other. Specifically, the channel (passage) of the discharge current including the odd number X-electrode driver 31, the pair of row electrodes (X and Y), and the odd number Y-electrode driver 41 is configured to have substantially the same impedance as the channel of the discharge current including the even number X-electrode driver 32, the pair of row electrodes (X and Y), and the even number Y-electrode driver 42.

Since the timing of the sustain discharges generated in the discharge cells belonging to the even numbered display lines is substantially the same as the timing of the sustain discharges generated in the discharge cells belonging to the odd numbered display lines, the magnetic fields are canceled out (counterbalanced) and the generation of the streaky unevenness on the display screen is prevented.

Figure 5:
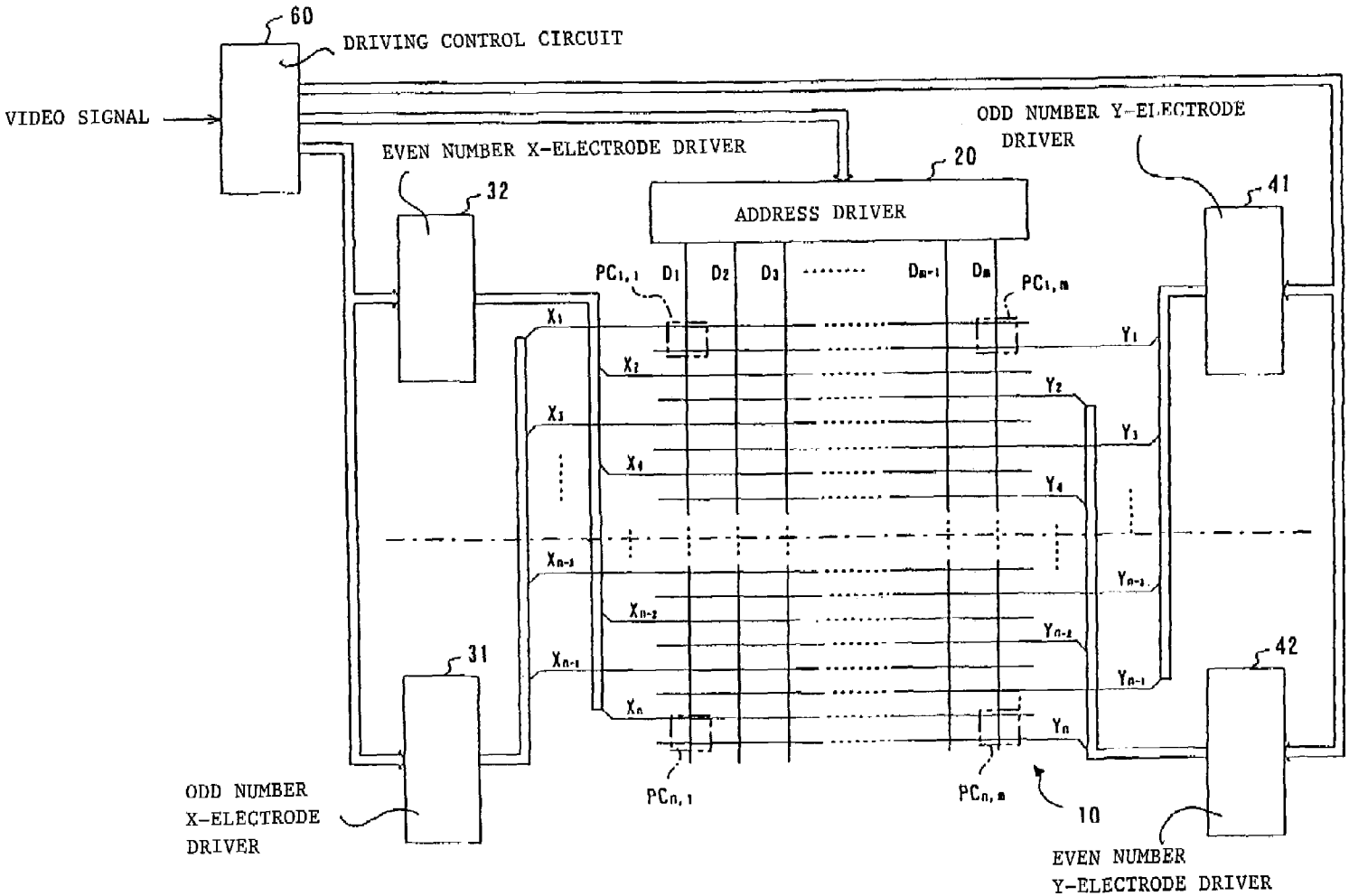
FIG. 5 shows a schematic structure of a PDP equipped with a driving apparatus according to another embodiment of the present invention.

Although the odd number X-electrode driver 31 and the even number Y-electrode driver 42 are positioned at the upper side of the screen of the PDP 10 with respect to the horizontal center line, and the even number X-electrode driver 32 and the odd number Y-electrode driver 41 are positioned at the lower side of the screen with respect to the center line in FIG. 3, the positions of the drivers are not limited to such allocation. For example, as shown in FIG. 5, the odd number X-electrode driver 31 and the even number Y-electrode driver 42 may be positioned at a lower side of the screen of the PDP 10 with respect to the horizontal center line (shown as a dashed line), and the even number X-electrode driver 32 and the odd number Y-electrode driver 41 may be positioned at an upper side of the screen with respect to the center line.

This application is based on a Japanese patent application No. 2002-258833 which is incorporated herein by reference.

What is claimed is:

1. A driving apparatus for driving a display panel which has a plurality of row electrode pairs aligned parallel with each other so as to serve as display lines on an internal surface of one of two substrates facing each other with a discharge space between the substrates, each row electrode pair including a first electrode and a second electrode, the driving apparatus comprising:

electrode driving means for generating an electrical discharge within the discharge space by alternately applying driving pulses to the first row electrode and the second row electrode forming each row electrode pair; and driving control means for controlling application timing of the driving pulses so that a flow direction of a discharge current which flows between the first row electrode and the second row electrode of each of the row electrode pairs belonging to odd numbered display lines due to the electrical discharge is opposite to a flow direction of the discharge current which flows between the first row electrode and the second row electrode of each of the row electrode pairs belonging to even numbered display lines;

wherein an impedance of a current channel for the discharge current which flows between the row electrode pair belonging to the odd numbered display line and the electrode driving means is substantially the same as an impedance of a current channel for the discharge current which flows between the row electrode pair belonging to the even numbered display line and the electrode driving means.

2. The driving apparatus for the display panel according to claim 1, wherein the electrode driving means comprises:

a first odd number electrode driver for applying the driving pulses to the first row electrode of each of the row electrode pairs belonging to the odd numbered display lines;

a second odd number electrode driver for applying the driving pulses to the second row electrode of each of the row electrode pairs belonging to the odd numbered display lines;

a first even number electrode driver for applying the driving pulses to the first row electrode of each of the row electrode pairs belonging to the even numbered display lines; and a second even number electrode driver for applying the driving pulses to the second row electrode of each of the row electrode pairs belonging to the even numbered display lines.

3. The driving apparatus for the display panel according to claim 2, wherein the first odd number electrode driver and the first even number electrode driver are positioned on one side of the row electrode pairs, and the second odd number electrode driver and the second even number electrode driver are positioned on the other side of the row electrode pairs, and the first odd number electrode driver and the second even number electrode driver are positioned at an upper side of a display surface with respect to a horizontal center line of the display surface, and the first even number electrode driver and the second odd number electrode driver are positioned at a lower side of the display surface with respect to the center line.

4. The driving apparatus for the display panel according to claim 2, wherein the first odd number electrode driver and the first even number electrode driver are positioned on one side of the row electrode pairs, and the second odd number electrode driver and the second even number electrode driver are positioned on the other side of the row electrode pairs, and the first odd number electrode driver is positioned lower than the first even number electrode driver on a surface defined by the display surface, and the second odd number electrode driver is positioned higher than the second even number electrode driver on the surface defined by the display surface.

5. The driving apparatus for the display panel according to claim 2, wherein each of the first odd number electrode driver, the second odd number electrode driver, the first even number electrode driver and the second even number electrode driver is an IC chip.

6. A driving apparatus for driving a display panel which has a plurality of row electrode pairs aligned parallel with each other so as to serve as display lines on an internal surface of one of two substrates facing each other with a discharge space between the substrates, each row electrode pair including a first electrode and a second electrode, the driving apparatus comprising:

an electrode driver for generating an electrical discharge within the discharge space by alternately applying driving pulses to the first row electrode and the second row electrode forming each row electrode pair; and a driving controller for controlling application timing of the driving pulses so that a flow direction of a discharge current which flows between the first row electrode and the second row electrode of each of the row electrode pairs belonging to odd numbered display lines due to the electrical discharge is opposite to a flow direction of the discharge current which flows between the first row electrode and the second row electrode of each of the row electrode pairs belonging to even numbered display lines;

wherein an impedance of a current channel for the discharge current which flows between the row electrode pair belonging to the odd numbered display line and the electrode driver is substantially the same as an impedance of a current channel for the discharge current which flows between the row electrode pair belonging to the even numbered display line and the electrode driver.

7. The driving apparatus for the display panel according to claim 6, wherein the electrode driver comprises:

a first odd number electrode driver for applying the driving pulses to the first row electrode of each of the row electrode pairs belonging to the odd numbered display lines;

a second odd number electrode driver for applying the driving pulses to the second row electrode of each of the row electrode pairs belonging to the odd numbered display lines;

a first even number electrode driver for applying the driving pulses to the first row electrode of each of the row electrode pairs belonging to the even numbered display lines; and a second even number electrode driver for applying the driving pulses to the second row electrode of each of the row electrode pairs belonging to the even numbered display lines.

8. The driving apparatus for the display panel according to claim 7, wherein each of the first odd number electrode driver, the second odd number electrode driver, the first even number electrode driver and the second even number electrode driver is an IC chip.

9. A driving apparatus for driving a display panel which has a plurality of row electrode pairs aligned parallel with each other so as to serve as display lines on an internal surface of one of two substrates facing each other with a discharge space between the substrates, each row electrode pair including a first electrode and a second electrode, the driving apparatus comprising:

electrode driving means for generating an electrical discharge within the discharge space by alternately applying driving pulses to the first row electrode and the second row electrode forming each row electrode pair; and driving control means for controlling application timing of the driving pulses so that a flow direction of a discharge current which flows between the first row electrode and the second row electrode of each of the row electrode pairs belonging to odd numbered display lines due to the electrical discharge is opposite to a flow direction of the discharge current which flows between the first row electrode and the second row electrode of each of the row electrode pairs belonging to even numbered display lines;

wherein a length of a current channel for the discharge current which flows between the row electrode pair belonging to the odd numbered display line and the electrode driving means is substantially the same as a length of a current channel for the discharge current which flows between the row electrode pair belonging to the even numbered display line and the electrode driving means.

10. The driving apparatus for the display panel according to claim 9, wherein the electrode driving means comprises:

a first odd number electrode driver for applying the driving pulses to the first row electrode of each of the row electrode pairs belonging to the odd numbered display lines;

a second odd number electrode driver for applying the driving pulses to the second row electrode of each of the row electrode pairs belonging to the odd numbered display lines;

a first even number electrode driver for applying the driving pulses to the first row electrode of each of the row electrode pairs belonging to the even numbered display lines; and a second even number electrode driver for applying the driving pulses to the second row electrode of each of the row electrode pairs belonging to the even numbered display lines.

11. The driving apparatus for the display panel according to claim 10, wherein the first odd number electrode driver and the first even number electrode driver are positioned on one side of the row electrode pairs, and the second odd number electrode driver and the second even number electrode driver are positioned on the other side of the row electrode pairs, and the first odd number electrode driver and the second even number electrode driver are positioned at a lower side of a display surface with respect to a horizontal center line of the display surface, and the first even number electrode driver and the second odd number electrode driver are positioned at an upper side of the display surface with respect to the center line.

12. The driving apparatus for the display panel according to claim 10, wherein the first odd number electrode driver and the first even number electrode driver are positioned on one side of the row electrode pairs, and the second odd number electrode driver and the second even number electrode driver are positioned on the other side of the row electrode pairs, and the first odd number electrode driver is positioned lower than the first even number electrode driver on a surface defined by the display surface, and the second odd number electrode driver is positioned upper than the second even number electrode driver on the surface defined by the display surface.

13. The driving apparatus for the display panel according to claim 10, wherein each of the first odd number electrode driver, the second odd number electrode driver, the first even number electrode driver and the second even number electrode driver is an IC chip.

14. A driving apparatus for driving a display panel which has a plurality of row electrode pairs aligned parallel with each other so as to serve as display lines on an internal surface of one of two substrates facing each other with a discharge space between the substrates, each row electrode pair including a first electrode and a second electrode, the driving apparatus comprising:

an electrode driver for generating an electrical discharge within the discharge space by alternately applying driving pulses to the first row electrode and the second row electrode forming each row electrode pair; and a driving controller for controlling application timing of the driving pulses so that a flow direction of a discharge current which flows between the first row electrode and the second row electrode of each of the row electrode pairs belonging to odd numbered display lines due to the electrical discharge is opposite to a flow direction of the discharge current which flows between the first row electrode and the second row electrode of each of the row electrode pairs belonging to even numbered display lines;

wherein a length of a current channel for the discharge current which flows between the row electrode pair belonging to the odd numbered display line and the electrode driver is substantially the same as a length of a current channel for the discharge current which flows between the row electrode pair belonging to the even numbered display line and the electrode driver.

15. The driving apparatus for the display panel according to claim 14, wherein the electrode driver comprises:

a first odd number electrode driver for applying the driving pulses to the first row electrode of each of the row electrode pairs belonging to the odd numbered display lines;

a second odd number electrode driver for applying the driving pulses to the second row electrode of each of the row electrode pairs belonging to the odd numbered display lines;

a first even number electrode driver for applying the driving pulses to the first row electrode of each of the row electrode pairs belonging to the even numbered display lines; and a second even number electrode driver for applying the driving pulses to the second row electrode of each of the row electrode pairs belonging to the even numbered display lines.

16. The driving apparatus for the display panel according to claim 15, wherein each of the first odd number electrode driver, the second odd number electrode driver, the first even number electrode driver and the second even number electrode driver is an IC chip.

* * * * *